US007131482B2

(12) United States Patent
Vincent et al.

(10) Patent No.: US 7,131,482 B2
(45) **Date of Patent: *Nov. 7, 2006**

(54) DISTRIBUTOR DEVICE FOR USE IN METAL CASTING

(75) Inventors: Mark Vincent, Leighton Buzzard (GB); Sylvain Tremblay, Jonquiere (CA)

(73) Assignee: Pyrotek Engineering Materials Limited, Milton Keynes (GB)

( * ) Notice: Subject to any disclaimer, the term of this patent is extended or adjusted under 35 U.S.C. 154(b) by 175 days.

This patent is subject to a terminal disclaimer.

(21) Appl. No.: 10/693,351

(22) Filed: Oct. 24, 2003

(65) Prior Publication Data

US 2004/0084172 A1 May 6, 2004

Related U.S. Application Data

(63) Continuation of application No. 10/048,695, filed on Jul. 19, 2002, now Pat. No. 7,036,555.

(51) Int. Cl.
*B22D 37/00* (2006.01)

(52) U.S. Cl. ..... 164/337; 164/437; 222/606; 222/594

(58) Field of Classification Search ..... 164/437, 164/337, 488, 489, 133, 134; 222/606, 594
See application file for complete search history.

(56) References Cited

U.S. PATENT DOCUMENTS

| | | | | |
|---|---|---|---|---|
| 2,757,425 A | | 8/1956 | Duncan et al. | |
| 2,876,509 A | * | 3/1959 | Gardner | 164/437 |
| 3,111,732 A | | 11/1963 | Schroer et al. | |
| 3,303,032 A | | 2/1967 | Holt et al. | |
| 3,654,150 A | | 4/1972 | Eccles | |
| 3,729,097 A | | 4/1973 | Collins et al. | |
| 3,850,684 A | * | 11/1974 | Gamble | 427/372.2 |
| 4,016,924 A | | 4/1977 | Maier | |
| 4,697,632 A | | 10/1987 | Lirones | |
| 4,834,876 A | | 5/1989 | Walker | |
| 5,081,640 A | * | 1/1992 | Bebber et al. | 373/25 |
| 5,207,974 A | | 5/1993 | Yun | |
| 5,227,078 A | * | 7/1993 | Augustine, III | 222/606 |
| 5,244,032 A | | 9/1993 | Banksden et al. | |
| 5,871,660 A | | 2/1999 | Xu et al. | |
| 6,202,735 B1 | | 3/2001 | Rittner | |
| 6,270,717 B1 | * | 8/2001 | Tremblay et al. | 266/230 |

FOREIGN PATENT DOCUMENTS

| | | |
|---|---|---|
| EP | 0 042 897 A1 | 1/1982 |
| EP | 184634 | 6/1986 |
| EP | 0 202 004 A2 | 11/1986 |
| EP | 0 302 975 A1 | 2/1989 |
| EP | 0 302 976 A1 | 2/1989 |
| EP | 0 463 257 B1 | 1/1992 |

(Continued)

*Primary Examiner*—Kevin Kerns
*Assistant Examiner*—I.-H. Lin
(74) *Attorney, Agent, or Firm*—Fay, Sharpe, Fagan, Minnich & McKee, LLP

(57) ABSTRACT

A distributor device for use in aluminium casting includes a rigid, substantially bowl-shaped receptacle (2) of a refractory material having a base member (4) and a peripheral wall (6) that extends upwards from the base. The receptacle has an inlet opening (8) towards the upper end thereof and a pair of outlet openings (14) towards the base thereof. The device is constructed and arranged such that, in use, molten aluminium poured into the distributor device through the inlet opening (8) is redirected by the distributor device and flows outwards into the mould through the outlet openings (14).

29 Claims, 5 Drawing Sheets

FOREIGN PATENT DOCUMENTS

| | | | |
|---|---|---|---|
| EP | 0 771 601 | A1 | 5/1997 |
| EP | 0847821 | | 6/1998 |
| GB | 1126922 | | 9/1968 |
| GB | 2 214 849 | A | 9/1989 |
| GB | 2 226 785 | A | 7/1990 |
| GB | 2 331 262 | A | 5/1999 |
| JP | 5-285612 | | 11/1993 |
| JP | 7-37445 | | 7/1995 |
| JP | 9-108781 | | 4/1997 |
| JP | 9-295108 | | 11/1997 |
| JP | 11-156487 | | 6/1999 |
| SU | 980 938 | | 12/1982 |
| WO | WO 90/02822 | | 3/1990 |
| WO | WO 99/44719 | | 9/1999 |

* cited by examiner

DISTRIBUTOR DEVICE FOR USE IN METAL CASTING

CROSS-REFERENCE TO RELATED APPLICATION

This application is a continuation of U.S. application Ser. No. 10/048,695 filed Jul. 19, 2002, now U.S. Pat. No. 7,036,555.

FIELD OF INVENTION

The invention relates to a distributor device for use in an aluminium casting operation.

BACKGROUND

In the process for manufacturing aluminium, after completion of the refining process, the molten aluminium is cast into ingots or billets that are subsequently used in processes for manufacturing aluminium products, for example aluminium foil.

During the casting operation, the molten aluminium is transferred from a holding furnace into a water-cooled mould above a casting pit, where it solidifies to form an aluminium ingot.

It is important that the flow of aluminium into the mould is smooth and non-turbulent, so that the solidification and temperature profile of the metal can be carefully controlled. If the flow is turbulent, impurities can be introduced into the aluminium, which can cause serious problems during subsequent manufacturing processes.

To avoid turbulence and to optimise distribution, the molten aluminium is usually poured into the mould through a distributor device. Conventionally, this consists of a flexible bag of coated woven glass fibres, known as a "combo bag", having an outer shell of solid woven fabric with normally two large openings through which the molten aluminium flows, and an inner liner of open-weave fabric. In use, the molten aluminium flows through the small pores of the open-weave liner, then through the openings in the outer shell, which helps to prevent turbulence in the flow of aluminium.

Conventional distributor devices can be used only once and are then discarded. However, because these devices are constructed largely by hand, they are relatively expensive and their use therefore adds significantly to the cost of the manufacturing process.

Conventional distributor devices are normally quite flexible, or at best semi-rigid. This means that the positioning and shape of the device can be inconsistent, and the dimensional accuracy of the device is difficult to measure and control within normal engineering tolerances. Furthermore, the coatings on the woven glass fibre weaken at metal casting temperatures, leading to reduced rigidity of the distributor. These factors combine to limit the reliability of metal distribution, and this leads to inconsistencies in the casting operation.

Further, fibres can occasionally come loose from the fabric of the distributor and become entrained in the molten aluminium, thereby introducing impurities into the aluminium ingot and potentially causing considerable difficulties in subsequent manufacturing processes.

Further, conventional distributors do not drain well after use and are sometimes provided with additional drain apertures in the bottom wall of the outer shell to ensure complete drainage. However, aluminium can also flow through these apertures during casting, thereby disturbing the desired liquid metal flow pattern.

Another distributor device described in U.S. Pat. No. 5,207,974 has a "bag-in-bag" design, comprising an inner bag of impermeable fabric and an outer bag having outlet openings. The device is suspended above the mould and liquid metal is poured into the inner bag. When the metal reached the top of the inner bag, it overflows into the outer bag, then flows through the openings into the mould. The bag is flexible and is susceptible to the disadvantages mentioned above.

U.S. Pat. No. 5,871,660 describes two different distributor devices. One of these is a flexible bag type, which is susceptible to the disadvantages mentioned above. The other device comprises a rigid nozzle having four outlet openings that are angled to direct the molten metal towards the sides of the mould. The nozzle is geometrically complex and is difficult and expensive to produce.

SUMMARY

It is an object of the present invention to provide a distributor device that mitigates at least some of the problems of the aforementioned distributor devices.

According to the present invention there is provided a distributor device for use in an aluminium casting operation to direct the flow of molten aluminium into a mould, the distributor device including a rigid, substantially bowl-shaped receptacle of a refractory material having a base member and a peripheral wall that extends upwards from the base, said receptacle having an inlet opening towards the upper end thereof and at least one outlet opening towards the base thereof, the device being constructed and arranged such that, in use, molten aluminium poured into the distributor device through the inlet opening is redirected by the distributor device and flows outwards into the mould through the at least one outlet opening.

The distributor device serves to direct the metal flow during casting. One of the advantages of using a rigid material is that it allows far more complex geometries to be made than can be achieved with conventional non-rigid systems, and allows those geometries to be reproduced consistently. This allows greater control and optimisation of the flow patterns emerging from the distributor, as well as opening up new ways of predicting the flow patterns (since 3-D fluid flow computer models work better with rigid structures).

Further, the device is not wetted by liquid aluminium and so is easy to clean. It may be slightly more expensive to manufacture than a disposable combo bag, but it can be re-used many times, thereby reducing wastage and providing a significant overall saving in costs. Also, the risk of loose fibres being trapped within the aluminium is avoided.

Any refractory material that is suitable for prolonged contact with molten aluminium may be used. These include fused silica, alumina, mullite, silicon carbide, silicon nitride, silicon aluminium oxy-nitride, zircon, magnesia, zirconia, graphite, wollastonite, calcium silicate, boron nitride (solid BN), aluminium titanate, aluminium nitride (AIN) and titanium diboride (TiB2) etc., or any composite of these materials. Alternatively, a suitable metal may be used, for example grey cast iron or titanium.

Advantageously, at least one outlet opening is provided in the peripheral wall, the device being constructed and arranged such that, in use, molten aluminium flows substantially horizontally outwards through said at least one outlet opening. This produces a good, non-turbulent flow pattern.

At least one outlet opening may be provided in the lower part of the peripheral wall, adjacent the base member, and the base member may be inclined towards the or each outlet opening. This provides good drainage.

Advantageously, the peripheral wall includes two side wall members and two end wall members. At least one outlet opening may be provided in each end wall member.

Advantageously, the separation of the side wall members increases towards the ends thereof. Preferably, the side wall members are curved. These features also promote a good, non-turbulent flow pattern.

The base member may include a raised flow deflector, to redirect the flow of aluminium as it is poured into the distributor device.

Advantageously, the peripheral wall is inclined outwards.

The distributor device may include a heating element for pre-heating the device, to prevent the metal freezing when pouring begins.

The distributor device may include a support structure, which may be designed to allow the device to be removed and replaced easily.

The distributor device may include a porous element constructed and arranged such that, in use, molten aluminium poured into the distributor device flows through said porous element. The porous element helps to reduce turbulence. It also acts as a filter device that traps inclusions and any large particles that may be washed into the distributor. Advantageously, the porous element includes a substantially bowl-shaped mesh of woven material that fits into and is supported by the receptacle, the arrangement being such that molten aluminium poured into the distributor device through the inlet opening flows through the mesh of woven material before exiting through the at least one outlet opening. Preferably, the porous element includes a mesh of coated glass fibres.

Advantageously, the porous element includes a support frame that, in use, engages and is supported by the receptacle.

According to another aspect of the invention there is provided a distributor device for use in aluminium casting, the distributor device including a rigid, substantially bowl-shaped receptacle of a refractory material having an inlet opening at the top and at least one outlet opening towards the base thereof, and an inner liner including a substantially bowl-shaped mesh of woven material that fits into and is supported by said rigid receptacle, the arrangement being such that molten aluminium poured into the distributor device through the inlet opening flows through the mesh of woven material before exiting through the at least one outlet opening.

The rigid receptacle supports the inner liner during the casting process and directs the flow of molten aluminium, while the inner liner helps to prevent turbulence. The receptacle can be used several times. It is therefore only necessary to replace the relatively inexpensive inner lining for each casting process, thereby reducing the cost of the process.

Advantageously, the rigid receptacle includes a ceramic shell. The ceramic shell can withstand the extremely high temperature of the molten aluminium and provide a rigid support for the inner liner. It is also relatively inexpensive. Further, because a fabric outer support is not required, the risk of loose fibres becoming entrained in the molten aluminium is significantly reduced.

Advantageously, the device includes means for supporting the rigid receptacle, which preferably allows the receptacle to be replaced relatively quickly and easily, when necessary.

Advantageously, the base of the rigid receptacle has an upper surface that is convex, to ensure good drainage of the device at the end of the casting process.

Advantageously, the rigid receptacle includes at least one heating element. This allows the receptacle to be pre-heated in situ prior to pouring the molten aluminium.

Advantageously, the inner liner includes a mesh of woven material, preferably of coated glass. This material can withstand the very high temperature of the molten aluminium.

Advantageously, the inner liner includes a support frame that, in use, engages and is supported by the rigid receptacle. This retains the inner liner in position and prevents it floating on the molten aluminium.

According to another aspect of the invention there is provided an aluminium casting installation including a mould, a delivery device for delivering molten aluminium into the mould and a distributor device according to any one of the accompanying claims, the distributor device being mounted below the delivery device and above the mould, the installation being constructed and arranged such that, in use, molten aluminium is poured from the delivery device into the mould through the distributor device.

Advantageously, the distributor device is positioned so that, during pouring, it is partially immersed in the liquid metal in the mould with the at least one outlet opening below the surface of the liquid metal.

BRIEF DESCRIPTION OF DRAWINGS

Embodiments of the present invention will now be described, by way of example, with reference to the accompanying drawings, in which.

DETAILED DESCRIPTION

Figure 1:
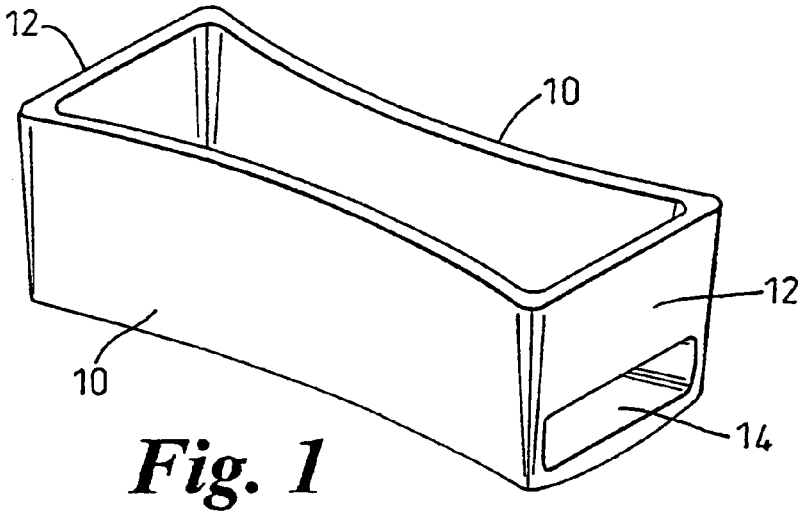
FIG. 1 is an isometric view of a first distributor device according to the invention.
Figure 2:
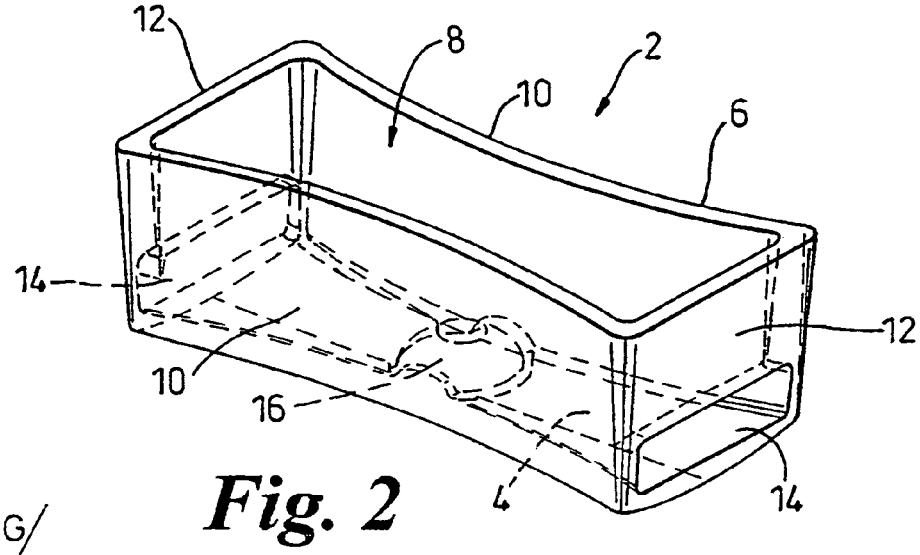
FIG. 2 is an isometric view of the first distributor device, showing some hidden details in broken lines.
Figure 3:
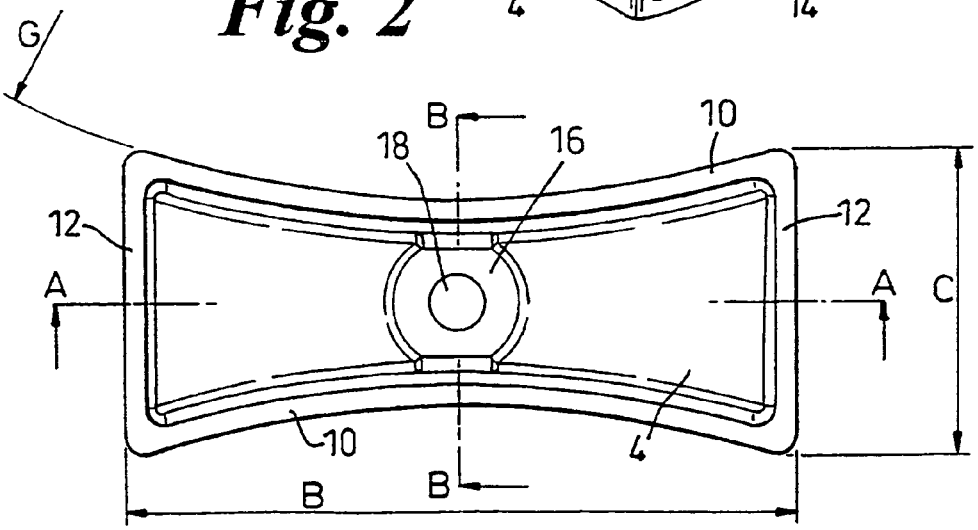
FIG. 3 is a top plan view of the first distributor device.
Figure 4:
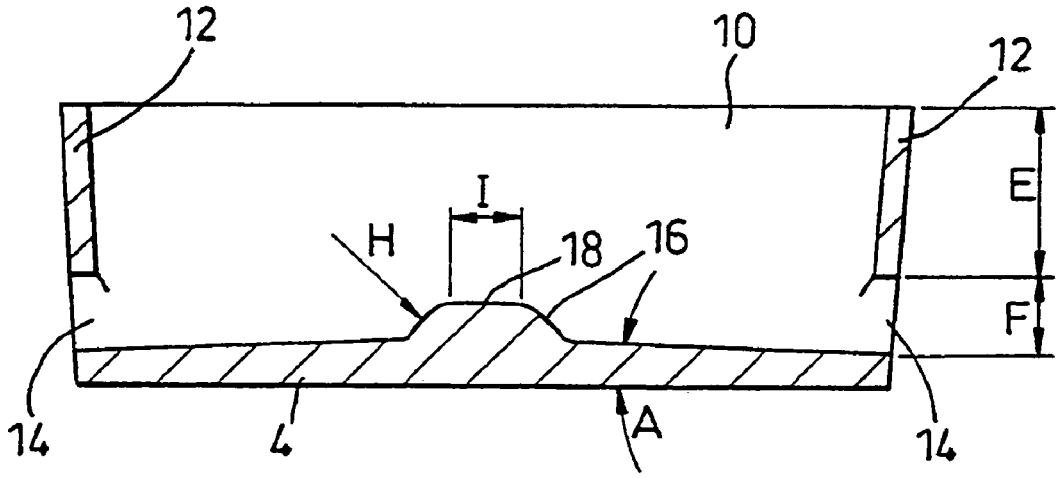
FIG. 4 is a side section on line A—A in FIG. 3.
Figure 5:
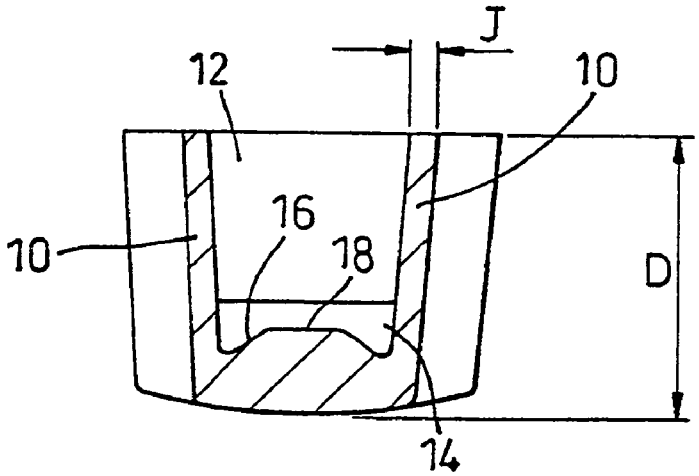
FIG. 5 is an end section on line B—B in FIG. 3.

A distributor device 2 according to a first embodiment of the invention is shown in FIGS. 1 to 5 of the drawings. The device is intended for use in an aluminium casting operation to direct the flow of molten aluminium into a mould, the device being located in use just above the mould, so that during pouring it is partially submerged below the surface of the molten metal in the mould.

The distributor device 2 includes a rigid, substantially bowl-shaped receptacle of a refractory material having a base member 4 and a peripheral wall 6 that extends upwards from the base and is inclined slightly outwards, forming an inlet opening 8 towards the upper end of the device. The peripheral wall 6 is four-sided and includes two side wall members 10 and two end wall members 12. The side wall members 10 are curved inwards lending the device a bi-concave shape, the separation of the side wall members increasing towards the ends of those walls.

An outlet opening 14 is provided in the lower part of each end wall member 12, the lower edge of each opening being flush with the upper surface of the base member 4. Each opening 14 extends substantially horizontally through the walls and is constructed and arranged such that, in use, molten aluminium flows substantially horizontally outwards through it.

The base member 4 is inclined towards the outlet openings 14 and includes a raised flow deflector element 16 that deflects the flow of molten aluminium poured into the device and directs it towards the outlet openings 14. The flow deflector element 16 is substantially hemi-spherical but has a flat top surface 18.

The shape and dimensions of the distributor are very important to ensure a smooth and predictable flow pattern. A specific example and preferred ranges of these dimensions, which have been found to provide extremely good results, are given in the table below.

| Dimension | Example | Preferred range |
|---|---|---|
| Base angle (A) | 5° | 0°–10° |
| Length (B) | 380 mm | 150–600 mm |
| Max. width (C) | 175 mm | 75–300 mm |
| Ratio B:C | 2.17 | 1.25–4 |
| Height (D) | 125 mm | 100–150 mm |
| Height of upper part of wall (E) | 75 mm | 50–100 mm |
| Height of opening (F) | 35 mm | 20–50 mm |
| Radius of curvature of wall (G) | 605 mm | 300–1200 mm |
| Radius of curvature of flow detector (H) | 40 mm | 20–60 mm |
| Diameter of central flat on flow detector (I) | 30 mm | 10–50 mm |
| Wall Thickness (J) | 12 mm | 1–25 mm |

The distributor device 2 may be made from any refractory material that is suitable for prolonged contact with molten aluminium. These include fused silica, alumina, mullite, silicon carbide, silicon nitride, silicon aluminium oxy-nitride, zircon, magnesia, zirconia, graphite, wollastonite, calcium silicate, boron nitride (solid BN), aluminium titanate, aluminium nitride (AIN) and titanium diboride (TiB2) etc. Furthermore, the device may be made from a composite material formed from a combination of the materials listed above, or it may be formed by impregnating a combination of these materials into a fibrous mat substrate. Alternatively, the distributor device may be made of a suitable metal, for example grey cast iron or titanium.

Figure 6:
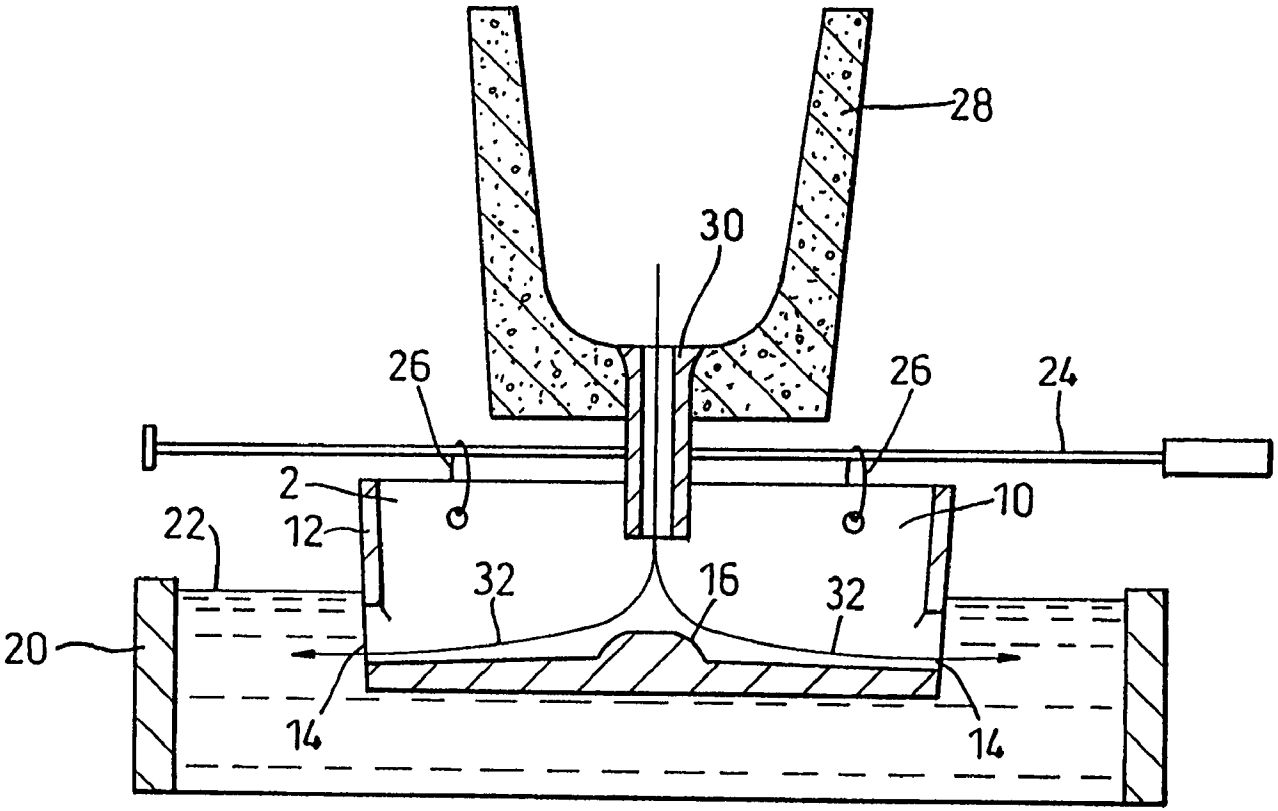
FIG. 6 is a side section showing the first distributor device mounted above a mould.

In use, the distributor device 2 is mounted within the upper part of a water-cooled mould 20, as shown in FIG. 6, with the outlet openings 14 just below the surface 22 of the molten aluminium in the mould. The distributor device is supported by two horizontal support rods 24 that pass through support loops 26 attached to the sides of the distributor device. Molten aluminium is poured from a holding furnace into a launder trough 28, from which it flows through a spout 30 into the open top of the distributor device 2. The liquid aluminium is deflected outwards by the deflector element 16 and is directed towards the end walls 12 by the curved side walls 10. The aluminium then flows outwards through the outlet openings 14 into the mould 20, where it solidifies to form an aluminium ingot. The flow of aluminium through the distributor device (which is illustrated by arrows 32) is determined by the shape of the device and the geometry of its outlets, which are designed to produce a smooth, controlled flow pattern of metal in the mould, with a predictable heat distribution.

Figure 7A:
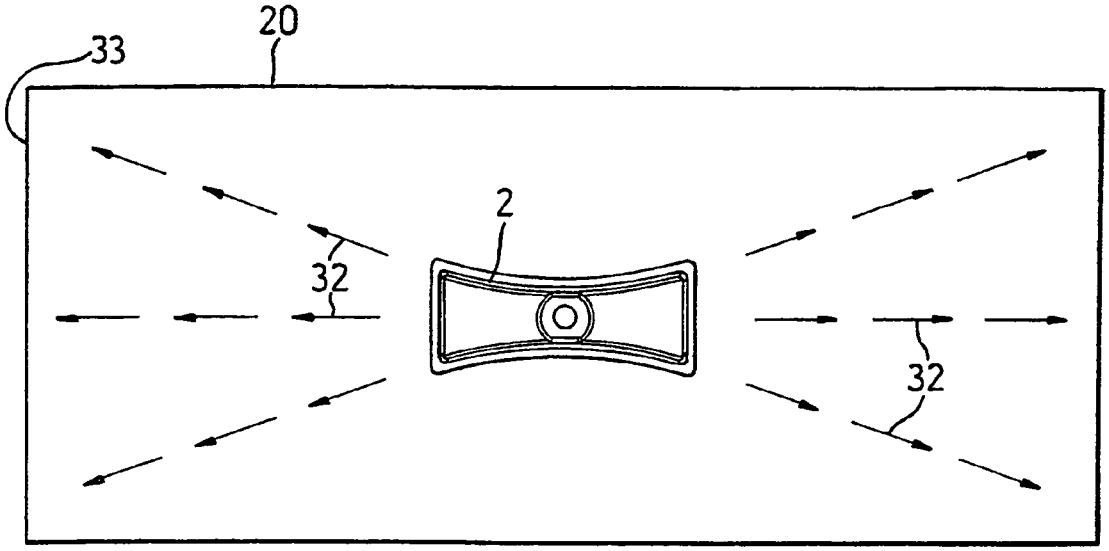
FIGS. 7*a* and 7*b* are flow distribution diagrams, illustrating the flow of molten aluminium through the device, in plan view and side view.
Figure 7B:
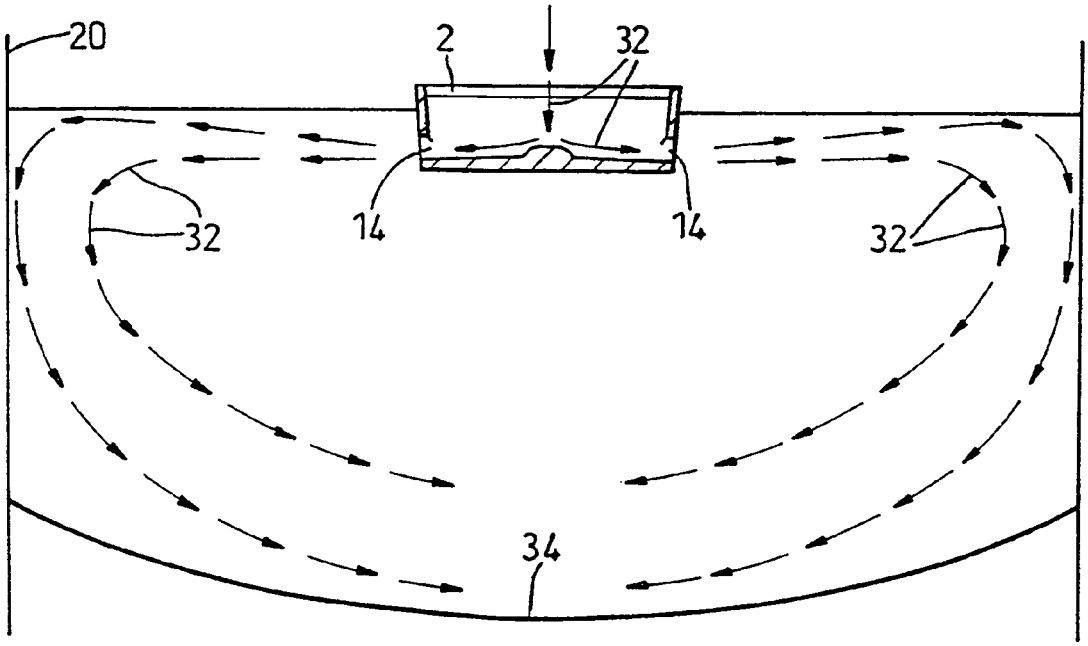

The flow pattern is illustrated in FIGS. 7*a* and 7*b*. As shown in plan view in FIG. 7*a*, the distributor device 2 directs the liquid metal towards the short sides 33 of the mould 20, and produces a diverging flow pattern with metal flowing towards the corners as well as the middle of those sides. The flow of metal from the distributor device is substantially horizontal initially, as shown in side section in FIG. 7*b*, and then turns downwards and inwards as it reaches the sides 33 of the mould, producing a heart-shaped pattern above the metal solidification front 34. This pattern is generally considered to be ideal, and results in a very high quality ingot or billet.

The device provides numerous advantages when used in the aluminium casting process. It is not wetted by liquid aluminium and so is easy to clean. The device is re-useable, reducing wastage. It is inexpensive to manufacture, reducing costs. It has a sloped base so that metal runs out at the end of the cast and it drains easily. The flow deflector reduces or eliminates turbulence at the point of the direction change between spout and distributor. The rigid receptacle walls are curved to generate the desired metal flow pattern. With an appropriate mounting system, the device can be replaced quickly and easily when necessary, allowing consistent placement and thus reliable metal distribution.

Various modifications of the device are possible, some of which will now be described. The device may include a mounting system for mounting it within the mould, for example by clamping or fixing a metal bracket to the top, sides, end or base of the device, or by integrating a suitable bracket into the device.

The device may include a porous element for reducing turbulence further and trapping surface based oxide inclusions generated by turbulence in the metal or any large particles that may be washed into the distributor. This element may be formed from any suitable porous material. It can be made, for example, by sewing coated woven glass fibre cloth, thermally forming a resin coated woven glass fibre cloth, by incorporating a steel wire into the woven glass fibre cloth, by producing a ceramic replica of a reticulated polyurethane foam, etc.

The device may include a heating element for heating the device in situ prior to use, to prevent the metal freezing when it first comes into contact with the device. For example, electrical heating elements can be incorporated into the walls and base of the device.

Figure 8:
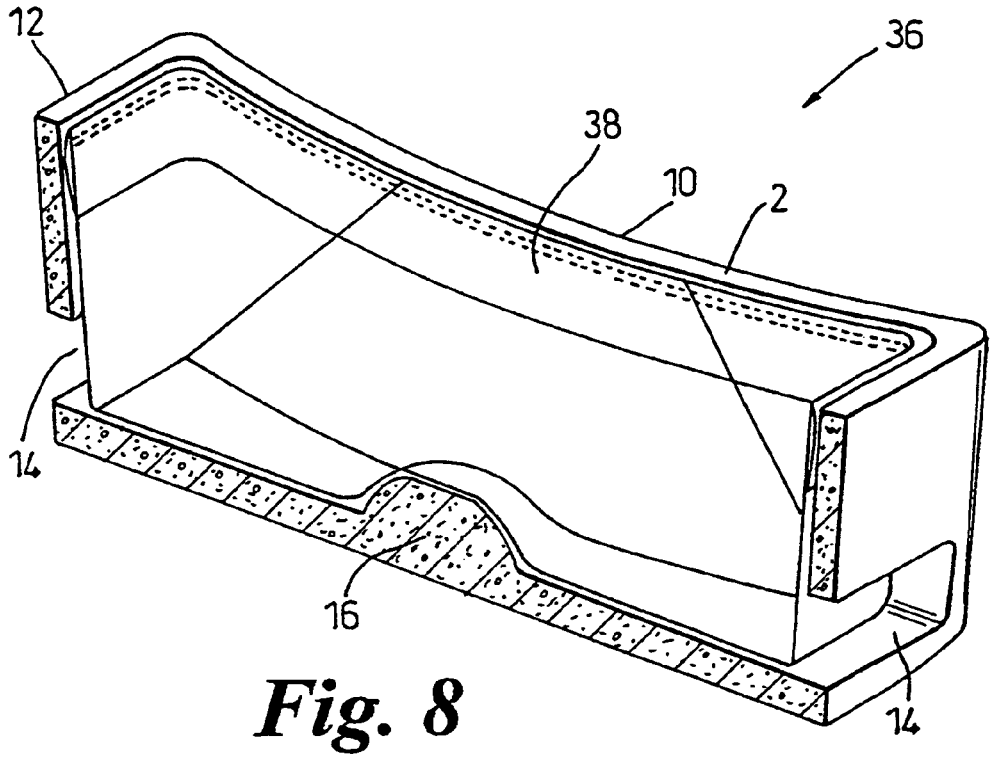
FIG. 8 is a sectional isometric view of a second distributor device according to the invention.
Figure 9:
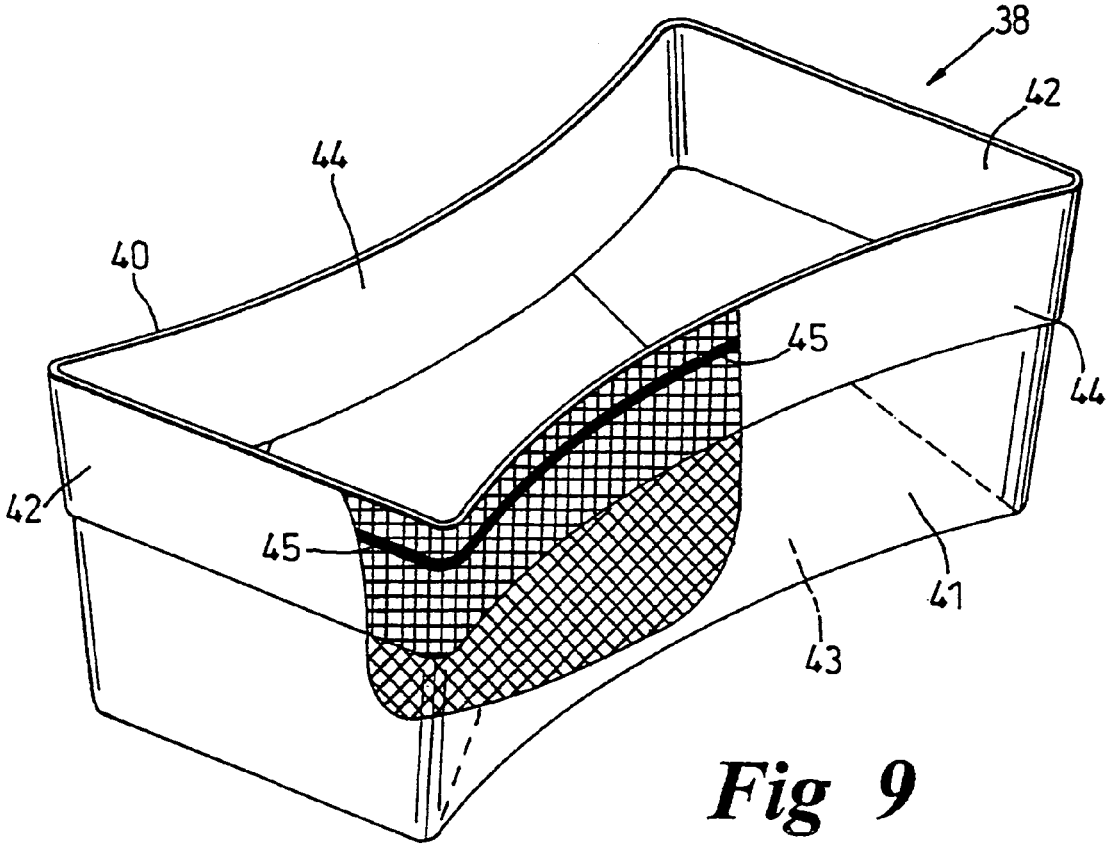
FIG. 9 is an isometric view of a fabric liner, forming an inner part of the second distributor device.

A second form of the distributor device is shown in FIGS. 8 and 9. This device 36 includes a rigid, bowl-shaped receptacle 2 and a woven fabric inner liner 38 that forms an inner part of the distributor device and fits inside the receptacle 2.

The receptacle 2 is substantially identical to the first distributor device described above, and will not be further described. The same reference numbers have been used to refer to similar parts.

The inner liner 38 is made from a coated open weave fabric of glass fibres. The coating can be either organic or inorganic. An organic coating may for example be a derivative of polyvinyl alcohol, whereas an inorganic coating can be a colloidal silica with a small quantity of starch to add stiffness.

The liner 38 is substantially bowl-shaped and designed to fit into the rigid receptacle 2. As shown in FIG. 9, it has a peripheral wall 40 with curved sides 41 and flat ends 42, and a substantially flat base 43. The upper part of the peripheral wall 40 is reinforced with a second layer 44 of woven glass fabric, which encapsulates a wire frame 45. The frame 45 is relatively springy, and provides additional stiffness to support the liner 38 in the outer receptacle 2.

In use, the inner liner 38 is placed in the outer ceramic receptacle 2. The frame 45 supports the liner against the walls 10,12 of the receptacle 2, and the liner adopts the internal shape of the receptacle, moulding itself over the deflector element 16, as shown in FIG. 8. The mesh extends over the outlet openings 14, so that liquid metal flowing through the distributor passes through the mesh.

The distributor device is suspended above the casting pit, substantially as shown in FIG. 6. As molten aluminium is poured into the distributor, it flows through the pores in the fabric inner liner 38, and out through the openings 14 in the receptacle 2. The rigid receptacle 2 directs the flow of molten aluminium, controlling the distribution and temperature profile of the metal in the mould, while the inner liner 38 reduces turbulence and traps surface based oxide inclusions and any large particles that may be washed into the distributor.

After use, the inner fabric liner 38 can be removed and discarded, leaving the ceramic receptacle 2 in place. The receptacle 2 may be used many times before it has to be replaced It is not therefore necessary to replace the entire distributor after every casting operation, thereby simplifying the manufacturing process and reducing cost and waste.

Optionally, the rigid receptacle 2 may include electric heating elements (not shown), allowing it to be pre-heated in situ to the temperature of the molten aluminium prior to the casting process.

Various modifications of the distributor device are possible. For example, the distributor need not necessarily have exactly the shape shown in the drawings but may be any shape, according to the dimensions and shape of the casting mould and the desired flow pattern. Additional windows and drain holes may also be provided, if required.

Further, the inner liner may be replaced by a woven fabric bag on the outside the rigid receptacle, so that it is the last component through which the molten aluminium passes before entering the mould. Alternatively, it may be replaced by a different porous element, for example a rigid reticulated ceramic foam block that fits inside the receptacle 2, or a woven sock that fits over the spout, to filter the metal as it is poured into the distributor device.

The invention claimed is:

1. A distributor device for use in an aluminium casting operation to direct the flow of molten aluminium into a mould, the distributor device comprising: a rigid, substantially bowl-shaped receptacle of a refractory material having a base member and a peripheral wall that extends upwards from the base member and includes two side wall members and two end wall members, said receptacle having an inlet opening towards the upper end thereof and at least one outlet opening in each of said end wall members towards the base member, the device being constructed and arranged such that in use, molten aluminium poured into the distributor device through the inlet opening is redirected by the distributor device and flows substantially horizontally outwards into the mould through said outlet openings; wherein the upper surface of the base member is inclined downwards towards the outlet openings.

2. The distributor device according to claim 1, wherein each outlet opening is arranged such that the upper surface of the base member and a lower boundary of the outlet opening is substantially flush such that the upper surface of the base member extends continuously through each end wall.

3. The distributor device according to claim 1, wherein the base angle "A" is greater than zero and less than ten degrees.

4. The distributor device according to claim 1, wherein the separation of the side wall members increases towards ends of the side wall members.

5. The distributor device according to claim 4, wherein the side wall members are curved.

6. The distributor device according to claim 1, wherein the base member includes a raised flow deflector.

7. The distributor device according to claim 1, wherein the peripheral wall is inclined outwards.

8. The distributor device according to claim 1, including a heating element for pre-heating the device.

9. The distributor device according to claim 1, including a support structure.

10. The distributor device according to claim 1, including a porous element constructed and arranged such that, in use, molten aluminium poured into the distributor device flows through said porous element.

11. The distributor device according to claim 10, in which the porous element includes a substantially bowl-shaped mesh of woven material that fits into and is supported by said receptacle, the arrangement being such that molten aluminium poured into the distributor device through the inlet opening flows through the mesh of woven material before exiting through said outlet openings.

12. The distributor device according to claim 10, wherein the porous element includes a mesh of coated glass fibres.

13. The distributor device according to claim 10, wherein the porous element includes a support frame that, in use, engages and is supported by the receptacle.

14. An aluminium casting installation including a mould, a delivery device for delivering molten aluminium into the mould and a distributor device according to claim 1, the distributor device being mounted below the delivery device and above the mould, the installation being constructed and arranged such that, in use, molten aluminium is poured from the delivery device into the mould through the distributor device.

15. The aluminium casting installation according to claim 14, wherein the distributor device is positioned so that, during pouring, it is partially immersed in the liquid metal in the mould with said outlet openings below the surface of the liquid metal.

16. A distributor device for use in an aluminium casting operation to direct the flow of molten aluminium into a mould, the distributor device comprising: a rigid, substantially bowl-shaped receptacle of a refractory material having a base member and a peripheral wall that extends upwards from the base member and includes two side wall members and two end wall members, said receptacle having an inlet opening towards the upper end thereof and at least one outlet opening in each of said end wall members towards the base member, the device being constructed and arranged such that, in use, molten aluminium poured into the distributor device through the inlet opening is redirected by the distributor device and flows outwards into the mould through said outlet openings; wherein the separation of the side wall members increases towards ends of the side wall members.

17. The distributor device according to claim 16, wherein the side wall members are curved.

18. The distributor device according to claim 16, wherein the base member includes a raised flow deflector.

19. The distributor device according to claim 16, wherein the upper surface of the base member is inclined downwards towards the outlet openings.

20. The distributor device according to claim 16, further comprising a porous element having a substantially bowl-shaped mesh of woven material that fits into and is supported by said receptacle, the arrangement being such that molten aluminium poured into the distributor device through the inlet opening flows through the mesh of woven material before exiting through the outlet openings.

21. A distributor device for use in an aluminium casting operation to direct the flow of molten aluminium into a mould, the distributor device comprising: a rigid, substantially bowl-shaped receptacle of a refractory material having a base member and a peripheral wall that extends upwards from the base member and includes two side wall members and two end wall members, said receptacle having an inlet opening towards the upper end thereof and at least one outlet opening in each of said end wall members towards the base member, the device being constructed and arranged such that in use, molten aluminium poured into the distributor device through the inlet opening is redirected by the distributor device and flows substantially horizontally outwards into the mould through said outlet openings; wherein the base member includes a raised flow deflector that is substantially hemispherical with a flat top.

22. The distributor device according to claim 21, wherein the separation of the side wall members increases towards ends of the side wall members.

23. The distributor device according to claim 22, wherein the side wall members are curved.

24. The distributor device according to claim 21, wherein the upper surface of the base member is inclined downwards towards the outlet openings.

25. The distributor device according to claim 21, further comprising a porous element having a substantially bowl-shaped mesh of woven material that fits into and is supported by said receptacle, the arrangement being such that molten aluminium poured into the distributor device through the inlet opening flows through the mesh of woven material before exiting through said outlet openings.

26. The distributor according to claim 21, wherein the raised flow deflector has a radius of curvature in the range 20 mm to 60 mm.

27. The distributor according to claim 26, wherein the raised flow deflector has a radius of curvature of approximately 40 mm.

28. The distributor according to claim 21, wherein the flat top has a diameter in the range 10 mm to 50 mm.

29. The distributor according to claim 28, wherein the flat top has a diameter of approximately 30 mm.

* * * * *

UNITED STATES PATENT AND TRADEMARK OFFICE

CERTIFICATE OF CORRECTION

PATENT NO. : 7,131,482 B2
APPLICATION NO. : 10/693351
DATED : November 7, 2006
INVENTOR(S) : Mark Vincent et al.

It is certified that error appears in the above-identified patent and that said Letters Patent is hereby corrected as shown below:

Title Page,

Item [30], Foreign Application Priority Data, should be inserted as follows:

--[30] Aug. 5, 1999 (GB) ..... 9918350--

Signed and Sealed this

Third Day of February, 2009

John Doll

JOHN DOLL
*Acting Director of the United States Patent and Trademark Office*